US010907316B2

(12) United States Patent
Kannegaard et al.

(10) Patent No.: US 10,907,316 B2
(45) Date of Patent: Feb. 2, 2021

(54) OFFSHORE APPARATUS AND METHOD

(71) Applicants: Maersk Drilling A/S, Kgs. Lyngby (DK); TOTAL E&P DANMARK A/S, København (DK)

(72) Inventors: Michael Kannegaard, Gentofte (DK); John Anthony Gill, Nottinghamshire (GB); Jeanne Mia Lønstrup, Copenhagen (GB); Meinte Van Der Brug, Copenhagen K (DK)

(73) Assignees: Maersk Drilling A/S, Kgs. Lyngby (DK); TOTAL E&P DANMARK A/S, København (DK)

( * ) Notice: Subject to any disclaimer, the term of this patent is extended or adjusted under 35 U.S.C. 154(b) by 153 days.

(21) Appl. No.: 15/771,684

(22) PCT Filed: Oct. 31, 2016

(86) PCT No.: PCT/DK2016/000042

§ 371 (c)(1),
(2) Date: Apr. 27, 2018

(87) PCT Pub. No.: WO2017/071711

PCT Pub. Date: May 4, 2017

(65) Prior Publication Data

US 2019/0063028 A1 Feb. 28, 2019

(30) Foreign Application Priority Data

Dec. 23, 2015 (GB) ..... 1522856.2
Jan. 21, 2016 (GB) ..... 1601175.1
(Continued)

(51) Int. Cl.
*E21B 15/00* (2006.01)
*E21B 41/00* (2006.01)
(Continued)

(52) U.S. Cl.
CPC ..... *E02B 17/0017* (2013.01); *E02B 17/021* (2013.01); *E02B 17/027* (2013.01);
(Continued)

(58) Field of Classification Search
CPC .. E02B 17/0017; E02B 17/021; E02B 17/027; E02B 15/00; E02B 15/02;
(Continued)

(56) References Cited

U.S. PATENT DOCUMENTS 3,861,463 A * 1/1975 Crowe ..... E21B 33/047 166/367
4,703,813 A 11/1987 Sieler
(Continued)

FOREIGN PATENT DOCUMENTS

GB 2026573 A 2/1980
GB 2536998 A 10/2016
WO 2014108542 A2 7/2014

OTHER PUBLICATIONS

International Search Report and Written Opinion for International Application No. PCT/DK2016/000042 dated May 19, 2017.
(Continued)

*Primary Examiner* — Daniel P Stephenson
(74) *Attorney, Agent, or Firm* — Carlson, Gaskey & Olds, P.C.

(57) ABSTRACT

An offshore platform for use in combination with an offshore rig comprises an upper deck defining an upper deck aperture which is alignable with a rig aperture of the offshore rig, when said offshore rig extends over the upper deck, to permit objects to extend between the offshore rig and through the upper deck. The offshore platform further includes a sheath arrangement aligned with the upper deck aperture and extending upwardly relative to the upper deck to be alignable with the rig aperture, wherein the sheath
(Continued)

arrangement defines a confinement zone for confining objects which pass downwardly from the offshore rig through the rig aperture.

27 Claims, 10 Drawing Sheets

(30) Foreign Application Priority Data

| | | |
|---|---|---|
| Apr. 23, 2016 | (GB) | 1607101.1 |
| Apr. 23, 2016 | (GB) | 1607102.9 |
| Apr. 23, 2016 | (GB) | 1607104.5 |
| Apr. 25, 2016 | (GB) | 1607180.5 |
| Apr. 25, 2016 | (GB) | 1607183.9 |
| Oct. 6, 2016 | (WO) | PCT/DK2016/000036 |

(51) Int. Cl.
*E21B 17/00* (2006.01)
*E02B 17/00* (2006.01)
*E21B 15/02* (2006.01)
*E02B 17/02* (2006.01)

(52) U.S. Cl.
CPC ..... *E21B 15/00* (2013.01); *E21B 15/02* (2013.01); *E21B 41/0021* (2013.01)

(58) Field of Classification Search
CPC .... E02B 41/0021; E02B 15/003; E21B 15/00; E21B 41/0021; E21B 15/003
See application file for complete search history.

(56) References Cited

U.S. PATENT DOCUMENTS

| | | | | |
|---|---|---|---|---|
| 4,932,811 | A * | 6/1990 | Folding | E02D 27/52 405/195.1 |
| 6,213,045 | B1 | 4/2001 | Gaber | |
| 2008/0031692 | A1* | 2/2008 | Wybro | B63B 21/502 405/224.4 |
| 2008/0166186 | A1* | 7/2008 | Pallini | E21B 19/24 405/224.4 |
| 2008/0205992 | A1* | 8/2008 | Ellis | E21B 19/002 405/224.4 |
| 2014/0224499 | A1* | 8/2014 | Sanders | E21B 19/00 166/339 |
| 2014/0305655 | A1* | 10/2014 | Otten | E21B 19/002 166/350 |
| 2016/0368573 | A1* | 12/2016 | Lisland | B63B 21/507 |
| 2017/0369133 | A1* | 12/2017 | Lambrakos | B63B 35/44 |
| 2018/0066481 | A1* | 3/2018 | Shilling, III | B63B 35/4413 |
| 2018/0216414 | A1* | 8/2018 | Gore | E21B 33/00 |
| 2018/0320331 | A1* | 11/2018 | Kannegaard | E21B 19/002 |
| 2018/0347135 | A1* | 12/2018 | Kannegaard | E21B 17/017 |
| 2019/0063028 | A1* | 2/2019 | Kannegaard | E02B 17/027 |
| 2019/0194895 | A1* | 6/2019 | Kannegaard | E21B 19/004 |

OTHER PUBLICATIONS

European Examination Report for European Application No. 16815708.9 dated Oct. 30, 2019.

* cited by examiner

OFFSHORE APPARATUS AND METHOD

FIELD

The present invention relates to offshore apparatus and methods, for example for use in the exploration and extraction of mineral resources from subterranean reservoirs.

BACKGROUND

In the offshore oil and gas industry wellbores are drilled below the seabed using specialised drilling platforms or vessels, known colloquially as drilling "rigs". Multiple types of drilling rig exist, such as fixed platforms, jack-up rigs, mobile offshore drilling units (MODUs), semi-submersibles, drilling ships and the like. The particular type of rig used can depend on a number of factors, such as water depth, rig availability, expected longevity of the associated reservoir, and the like.

Once a well has been drilled and appraised, it will be completed with the appropriate downhole infrastructure to permit production (and/or injection), and then capped at the wellhead with a production tree, known as a X-mas tree. Such completion operations may be achieved from the same drilling rig, or may be achieved using a different service rig. Further, during the life of the well it may be necessary to perform workover or intervention operations, which again could be supported by the drilling rig, or alternatively with a different service or workover rig.

The production tree may be located on a subsea wellhead, with a tie back to a surface production facility. In alternative arrangements the tree may be located at surface, on a surface or wellhead platform. Multiple wellbores will typically be present, such that a cluster of trees are provided on the wellhead platform.

Surface tree systems will typically require rigs, such as drilling rigs, service rigs, workover rigs and the like to operate alongside the wellhead platform. For example, portions, such as cantilever portions, of a rig may extend over the wellhead platform. Like in all offshore operations, safety is paramount, and risk to personnel, the environment and equipment must be minimised. In many circumstances there is a risk of objects being dropped from height, for example between separate decks of a wellhead platform, or indeed from a rig operating alongside a wellhead platform. For safety reasons some operators may establish no-entry zones for personnel, for example in defined drop zones, such as below a rig cantilever portion. This may restrict or delay certain operations which cannot otherwise be performed while the rig cantilever portion is in position, or while inter-deck operations are being performed. Also, irrespective of personnel access, there will always be a risk of damage to equipment, such as production trees, from dropped objects and the like. This may be compounded by the close proximity of equipment in tree clusters on the production platform.

SUMMARY

An aspect or embodiment relates to an offshore platform for use in combination with an offshore rig, comprising:

an upper deck defining an upper deck aperture which is alignable with a rig aperture of the offshore rig, when said offshore rig extends over the upper deck, to permit objects to extend between the offshore rig and through the upper deck; and a sheath arrangement aligned with the upper deck aperture and extending upwardly relative to the upper deck to be alignable with the rig aperture, wherein the sheath arrangement defines a confinement zone for confining objects which pass downwardly from the offshore rig through the rig aperture.

In use, any objects passing, for example intentionally passing and/or accidentally passing (i.e., dropped), from the offshore rig may be confined within the confinement zone defined by the sheath arrangement. Such confinement provided by the sheath arrangement may thus minimise or eliminate the extent of a drop zone on the upper deck. This may provide a number of advantages. For example, the risk to personnel may be reduced, and may permit personnel to perform operations on the upper deck while the offshore rig is extended over the upper deck. Further, the risk of damage to equipment may be reduced, such as the risk of damage to wellheads and associated equipment (such as production trees) accommodated on the offshore platform.

In normal operations objects may extend form the offshore rig, through the upper deck of the offshore platform, to perform operations associated with the installation, intervention and/or decommissioning of an offshore well. Objects passing from the offshore rig may include tubing, conductor pipe, casing strings, liners, risers, drill strings, bottom hole assemblies, completion equipment, intervention equipment, tools and the like. While many objects may be intentionally passed, in some instances objects may be dropped from the offshore rig, such as tools, equipment and the like, and as noted above, the sheath arrangement assists to minimise risk from such dropped objects.

The offshore rig may define a drilling rig. The offshore rig may be operable adjacent, for example alongside, the offshore platform. The offshore rig may comprise a cantilever portion which is extendable over the offshore platform. The cantilever portion may comprise the rig aperture. The cantilever portion may comprise a BOP (Blow Out Preventor) enclosure.

The offshore rig may define a service rig, workover rig or the like.

The offshore rig may define a drill centre, wherein operations supported by the offshore rig, such as drilling, running equipment and the like, are provided along the drill centre. Accordingly, the rig aperture is provided on the drill centre. The offshore rig may be positioned over the offshore platform such that the drill centre is aligned with the upper deck aperture.

Although the term "drill centre" is used, this is not intended to be limited only to drilling operations, or indeed to limit the rig to a drilling rig.

The offshore platform may define a wellhead platform. In such an arrangement the offshore platform may accommodate a terminating end of one or more surface wells, along with associated equipment, such as wellheads, production trees and the like.

Generally, a wellhead platform is a structure or structures, which support the upper end (opposite of the reservoir) of the well including any superstructures, one or more well processing stations or similar. Such a wellhead platform is typically a structure (such as a jacket based or gravity based platform) resting on the seabed ranging from very basic configurations to complex facilities. The offshore wellhead platform may comprise one or more well-processing stations. Alternatively, the offshore wellhead platform does not comprise any well-processing stations. In such cases, well-processing tasks such as drilling may be performed by a drilling rig placed next to the wellhead platform.

The wellhead platform typically fulfils one or more of the following functions in supporting a well:

(i) shield the well from accidental impacts from ships and vessels;

(ii) keeping a completed surface well from otherwise tipping over;

(iii) provide structure where pipes can be mounted for connecting to a valve assembly or production tree mounted on each well and interfacing these pipes with various equipment or manifolds on and/or off the platform, such as pumps and storage tanks;

(iv) supporting production trees so that they are substantially static relative to the platform (at least during production) as the platform and/or well is exposed to forces from current, wind and wave.

The sheath arrangement may define a circumferential confinement zone. The sheath arrangement may comprise one or more tubulars.

The sheath arrangement may circumscribe the upper deck aperture. The sheath arrangement may extend upwardly from the level of the upper deck. That is, no gap between the upper deck and the sheath arrangement may be present. Such an arrangement may assist to minimise risk of objects being dropped from the upper deck and through the upper deck aperture downwardly to a lower deck.

The sheath arrangement may be securable around a peripheral region of the upper deck aperture. The sheath arrangement may be securable around a peripheral region of the rig aperture.

The sheath arrangement may extend through the upper deck aperture. This may assist to minimise the risk of objects being dropped from the upper deck and through the upper deck aperture downwardly to a lower deck.

The sheath arrangement may extend through the rig aperture.

At least a portion of the sheath arrangement may be rigid.

At least a portion of the sheath arrangement may be flexible. At least a portion of the sheath arrangement may comprise a flexible material, such as a chain-link material. The sheath arrangement may define a sheath curtain. Such an arrangement may provide advantages in terms of installation, storage, and the like.

At least a portion of the sheath arrangement may be formed or comprise a metal or metal alloy material, composite material, plastic material or the like.

At least a portion of the sheath arrangement may be supported by the upper deck. At least a portion of the sheath arrangement may be secured to the upper deck. At least a portion of the sheath arrangement may be supported by the offshore rig. At least a portion of the sheath arrangement may be secured to, for example suspended from, the offshore rig.

At least a portion of the sheath arrangement may be provided on the offshore rig. For example, a portion of the sheath arrangement may be provided on the offshore rig, and a remaining portion of the sheath arrangement may be mated or otherwise arranged relative to the portion provided on the rig.

At least a portion of the sheath arrangement may be extended, for example lowered, from the offshore rig, for example through the rig aperture, during deployment of the sheath arrangement. The sheath arrangement may be deployed entirely from the offshore rig, for example by extending downwardly towards the platform.

At least a portion of the sheath arrangement may be extended, for example raised, from the offshore platform an upwardly towards the offshore rig during deployment of the sheath arrangement. The sheath arrangement may be deployed entirely from the platform, for example by extending upwardly towards the rig.

The sheath arrangement may comprise a load point or support on an outer surface thereof. The load point or support may permit connection of a load to the sheath arrangement. This may permit the sheath arrangement to at least partially support a connected load.

The sheath arrangement may comprise a support arrangement on an outer surface thereof. This may permit the sheath arrangement to be used as a structural support to facilitate offline (i.e., offset from the drill centre) operations such as slickline and wireline operations, hoisting operations such as during installation of production trees and the like. The support arrangement may comprise one or more arms, for example cantilever arms. The support arrangement may comprise one or more pulleys, sheaves or the like. The support arrangement may comprise a winch assembly.

The sheath arrangement may comprise a unitary component. Alternatively, the sheath arrangement may comprise multiple components. In one embodiment the sheath arrangement may comprise a first component connected or mounted to the offshore platform, and a second component connected or mounted to the offshore rig.

The sheath arrangement may be telescopic. For example, the sheath arrangement may comprise telescoping tubular structures. This may facilitate storage of the sheath arrangement when not in use. This may facilitate improved deployment of the sheath arrangement. Such a telescoping arrangement may provide a degree of movement compensation, for example to accommodate relative movement between the offshore platform and offshore rig.

The sheath arrangement may extend downwardly relative to the upper deck towards a first lower deck. The sheath arrangement may therefore define a confinement zone for confining objects passing between the upper and first lower decks. This may minimise or eliminate the extent of a drop zone on the first lower deck.

The offshore platform may accommodate equipment or apparatus associated with surface wells within the space defined between the first lower deck and upper deck. Such equipment or apparatus may comprise wellheads, production trees, pipework and the like. The provision of a confinement zone between the first lower and upper decks, in addition to reducing risk to personnel, may also reduce risk of damage to such sensitive equipment.

The sheath arrangement may define a continuous confinement zone both above and below the upper deck.

The first lower deck may define a first lower deck aperture aligned with the upper deck aperture.

The sheath arrangement may define an upper sheath portion extending upwardly relative to the upper deck and a lower sheath portion extending downwardly relative to the upper deck. At least part of the upper and lower sheath portions may be integrally formed.

The sheath arrangement may terminate at the first lower deck. The sheath arrangement may terminate above the first lower deck. The sheath arrangement may extend through a lower deck aperture. The sheath arrangement may extend below the first lower deck, for example towards a second lower deck.

The sheath arrangement, or portions thereof may define a permanent installation.

The sheath arrangement, or portions thereof, may be removable.

The offshore rig may be used to support a number of procedures or operations. For example, rig operations may include deploying and installing a conductor, drilling through a conductor, re-entering an existing well, deploying completion equipment and the like.

The offshore platform may accommodate multiple wells arranged in a cluster around the drill centre. The upper ends of the wells may be moveable to be aligned with the drill centre of the offshore rig. This may permit multiple wells to be established and accessed from a common drill centre. Such movement/alignment of the wells may be performed in accordance with desired operator procedures, such as those described in the applicant's co-pending patent applications DK PA2015 00668 and GB 1522856.2, the disclosure of which is incorporated herein by reference.

In one example, the offshore platform may be configured to selectively allow access to the wells. For example, the sheath arrangement itself, or indeed the platform, may comprise a plate arrangement. Such a plate arrangement may be configured to form a flange, when associated with the sheath arrangement, to selectively prevent objects or equipment from accessing the wells, (e.g. those wells not at the drill centre).

In some examples, the plate arrangement may comprise an operable hatch or otherwise opening. Such a hatch may permit, when opened, access to the wells (e.g. to permit intervention operations to be carried out on the other wells when the sheath arrangement is at the drill centre.) The plate arrangement may be configured to allow access to other wells when drilling operations are occurring through the sheath arrangement (e.g. even at times when the plate arrangement is associated with the sheath arrangement).

In some examples, the plate arrangement may comprise at least one separation plate. Such a separation plate may be configured to extend downwardly from the plate arrangement. Such a separation plate may be configured to inhibit objects passing through the hatches to adjacent regions at the platform (e.g. adjacent wells). Further, such a separation plate may be configured to come into contact with a deck as the sheath arrangement is lowered, which may reduce or avoid impact of the sheath arrangement on wellheads.

The sheath arrangement may comprise an access hatch. The access hatch may be arranged such that, when in situ, the access hatch is user accessible from a deck (e.g. the upper deck). Such an access hatch, when opened, may permit access to the equipment passing within the sheath arrangement.

The sheath arrangement may be configured to flex compliantly in order to accommodate relative movement between the offshore rig and upper deck, when in use. For example, the sheath arrangement, or at least a portion thereof, may be axially and/or longitudinally compliant in order to accommodate relative movement between the offshore rig and upper deck, when in use. In some examples, the sheath arrangement may comprise specific compliant portions, for example one or more flexible joints.

An aspect or embodiment relates to a method for confining objects extending between an offshore rig and an offshore platform, comprising extending a sheath arrangement upwardly relative to an upper deck of the offshore platform, wherein the sheath arrangement is aligned with a rig aperture of the offshore rig such that the sheath arrangement defines a confinement zone for confining objects which pass downwardly from the offshore rig through the rig aperture.

An aspect or embodiment relates to a sheath arrangement for use between an upper deck of an offshore platform and an offshore rig positioned over the offshore platform, wherein the sheath arrangement is alignable with a rig aperture provided on the rig and defines a confinement zone for confining objects which pass downwardly from the offshore rig through the rig aperture.

The features defined in relation to one aspect may be provided in combination with any other aspect.

BRIEF DESCRIPTION OF THE DRAWINGS

These and other aspects and examples will now be described, by way of example only, with reference to the accompanying drawings, in which.

DETAILED DESCRIPTION OF THE DRAWINGS

Figure 1A:
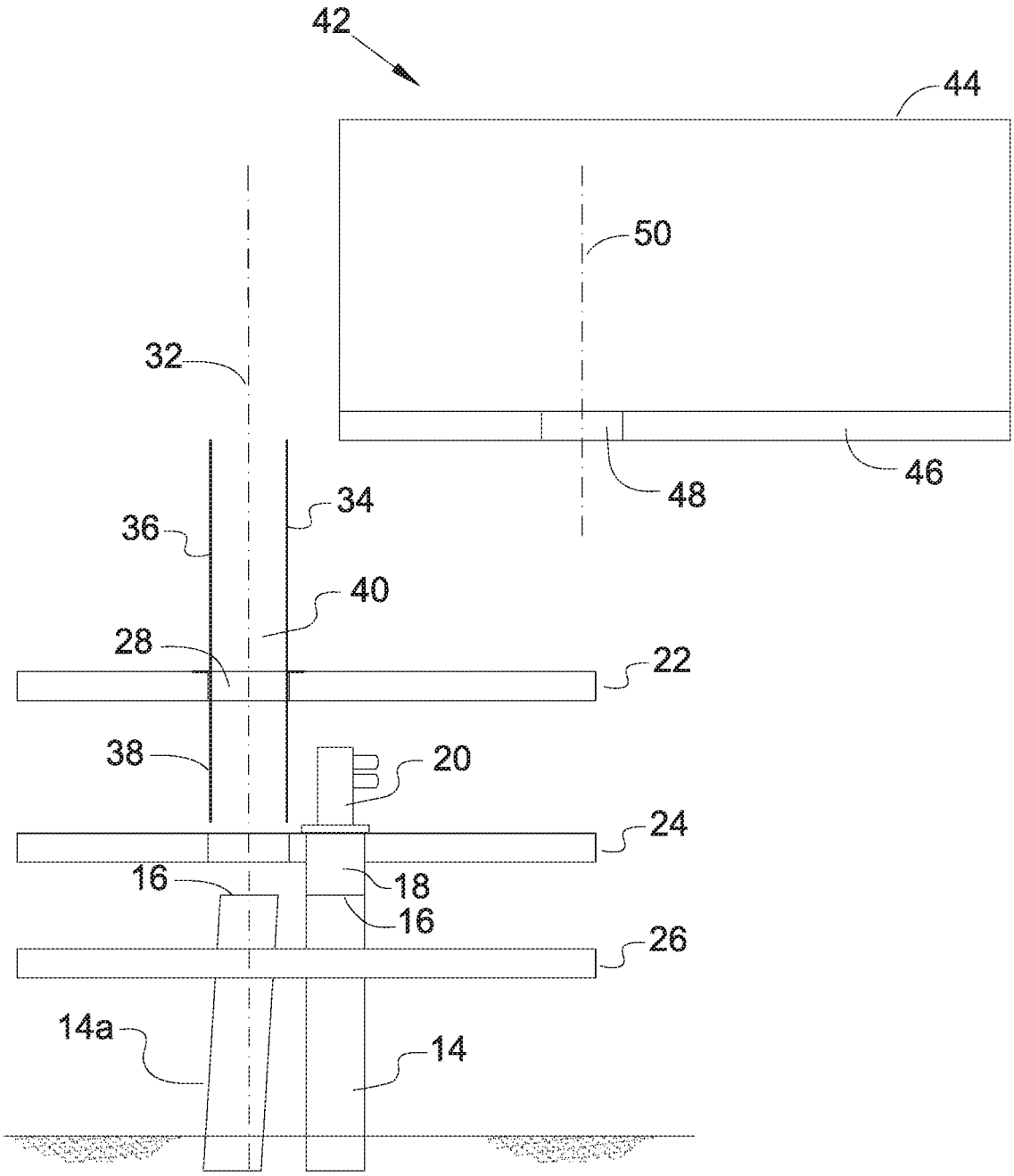
FIG. 1A is a diagrammatic illustration of a portion of an example offshore platform which includes a sheath arrangement, prior to positioning of a cantilever portion of a separate drilling rig.

FIG. 1 diagrammatically illustrates an offshore platform, specifically an offshore wellhead platform, generally identified by reference numeral 10, which extends above a sea surface 12. The platform 10 accommodates a number of well structures 14 which extend from their terminating upper ends 16, through the sea and into the seabed, to intercept a subterranean formation. As is known in the art, the well structures 14 will typically include an outer conductor pipe and a number of concentrically arranged casing strings cemented within the conductor pipe. Each well structure 14 terminates at a wellhead 18 and is capped with a production or X-mas tree 20.

The platform 10 includes a number of decks, including an upper deck 22, a first lower deck 24 and a second lower deck 26 arranged one above the other. Multiple terms are used in the art to define or classify each deck. For example, the upper deck 22 may be known as a weather deck. The first lower deck 24 may be defined as a wellhead or tree deck, in that, at least in the present example, the wellheads 18 and production trees 20 are located generally at the level of the first lower deck 24. The second lower deck 26 may be defined as a cellar deck.

The upper deck 22 defines an upper deck aperture 28, and the first lower deck 24 defines a first lower deck aperture 30, wherein the respective apertures 28, 30 are aligned on a platform axis 32. The second lower deck 26 may also include a corresponding aperture, although this is not illustrated. In the example illustrated the wells 14 are arranged in a cluster around the platform axis. Whenever well access is required, for example during well construction, intervention or the like, the upper end 16 of the well 14 is moved into line with the platform axis 32, resulting in bending of the well 14, as exemplified by well 14*a*. Such movement may be performed as described in the applicant's co-pending patent applications DK PA2015 00668 and GB 1522856.2, the disclosure of which is incorporated herein by reference.

The offshore platform 10 includes or is associated with a sheath arrangement 34 which is aligned on the platform axis 32 and includes an upper portion 36 which extends upwardly relative to the upper deck 22, and a lower portion 38 which extends downwardly relative to the upper deck 22 towards the lower deck 24. The lower portion 38 in the illustrated example terminates just above the first lower deck 24. The sheath arrangement 34 thus defines a confinement zone 40 above both the upper and first lower decks 22, 24.

In typical offshore operations a rig will be operated alongside a wellhead platform, to perform operations such as drilling, installing well infrastructure, performing workover or intervention operations, and the like. In FIG. 1 a rig cantilever 42 is illustrated alongside the offshore platform 10. The rig cantilever 42 includes a BOP enclosure 44 which includes a rig floor 46 (which may be defined as a drill floor), with a rig aperture 48 defined in the rig floor 46. The rig cantilever 42 defines a drill centre 50 which is aligned with the rig aperture 48.

Figure 1B:
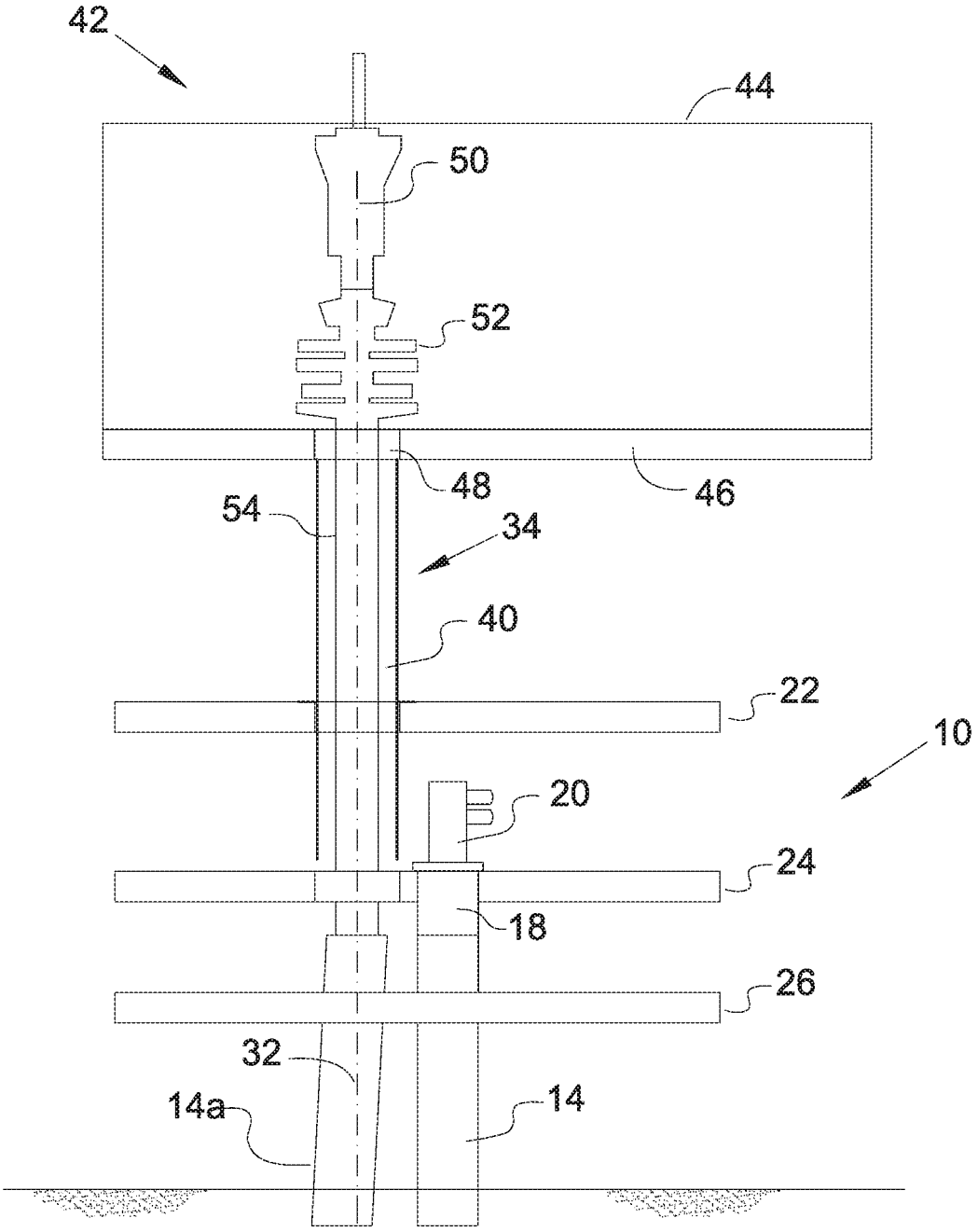
FIG. 1B illustrates the platform of FIG. 1A, with the cantilever portion of the drilling rig aligned above the platform.

The rig cantilever 42 will be moved over the offshore platform 10, as illustrated in FIG. 1B, such that the drill centre 50 of the rig cantilever 42 is aligned with the platform axis 32. When the rig cantilever 42 is in place, the sheath arrangement 34 is thus aligned with the rig aperture 48, such that all operations from the rig cantilever 42 are performed through the sheath arrangement 34, specifically within the confinement zone 40 defined by the sheath arrangement 34, thus improving safety on the upper and first lower decks 22, 24. In the example illustrated in FIG. 1B a drilling operation is being performed through well 14*a*, using typical drilling equipment such as a drilling BOP 52, drilling riser 54 and the like.

In addition to normal operations through the sheath arrangement 34, the confinement zone 40 may also function to confine objects which are accidentally dropped through the rig aperture 48. In addition to improved personnel safety, this can also assist to minimise risk of damage to equipment, such as the wellheads 18 and production trees 20 accommodated on the platform 10.

In the embodiment illustrated in FIGS. 1A and 1B the sheath arrangement includes one or more rigid tubular bodies, which may be made from metal, such as steel. However, in other examples other material may be used, such as polymers, composite material or the like.

Figure 2:
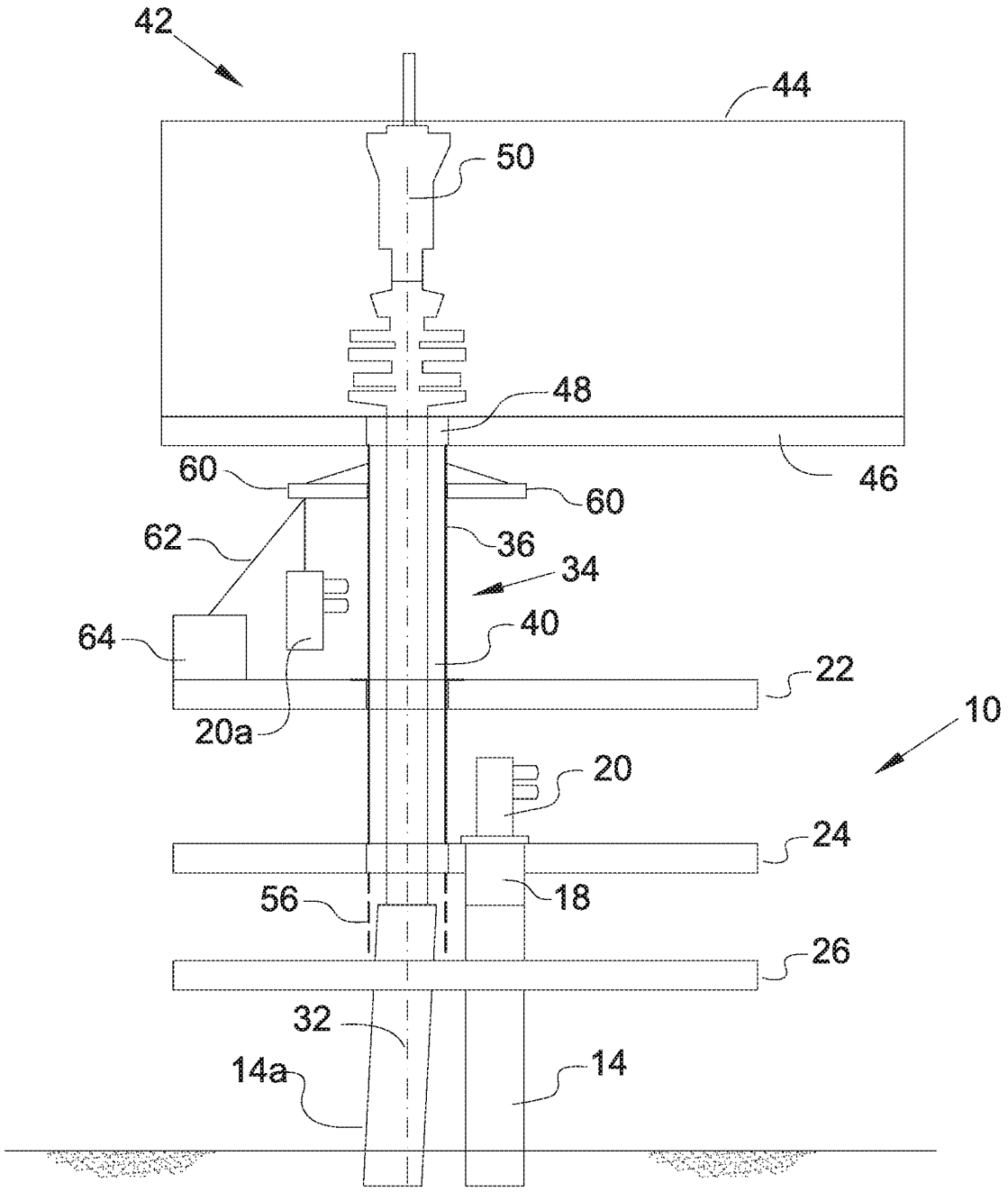
FIG. 2 is a diagrammatic illustration of a modified example of an offshore platform.

In a modified example, as illustrated in FIG. 2, the sheath arrangement 34 may include a second lower section 56 (shown in broken outline) which extends below the first lower deck 24 towards the second lower deck 26.

Further, the sheath arrangement 34, and specifically the upper portion 36 of the sheath arrangement 34 includes supports in the form of cantilever support arms 60. Although two arms 60 are illustrated in FIG. 2 more or less arms may be provided. The arms 60 may be used for a number of support operations, effectively permitting the sheath arrangement to act as a structural component for supporting load. In FIG. 2 one arm 60 is illustrated in use as a hoisting point, permitting manipulation of a load, such as the illustrated production tree 20*a*, in combination with a wire 62 and associated winch 64.

Figure 3A:
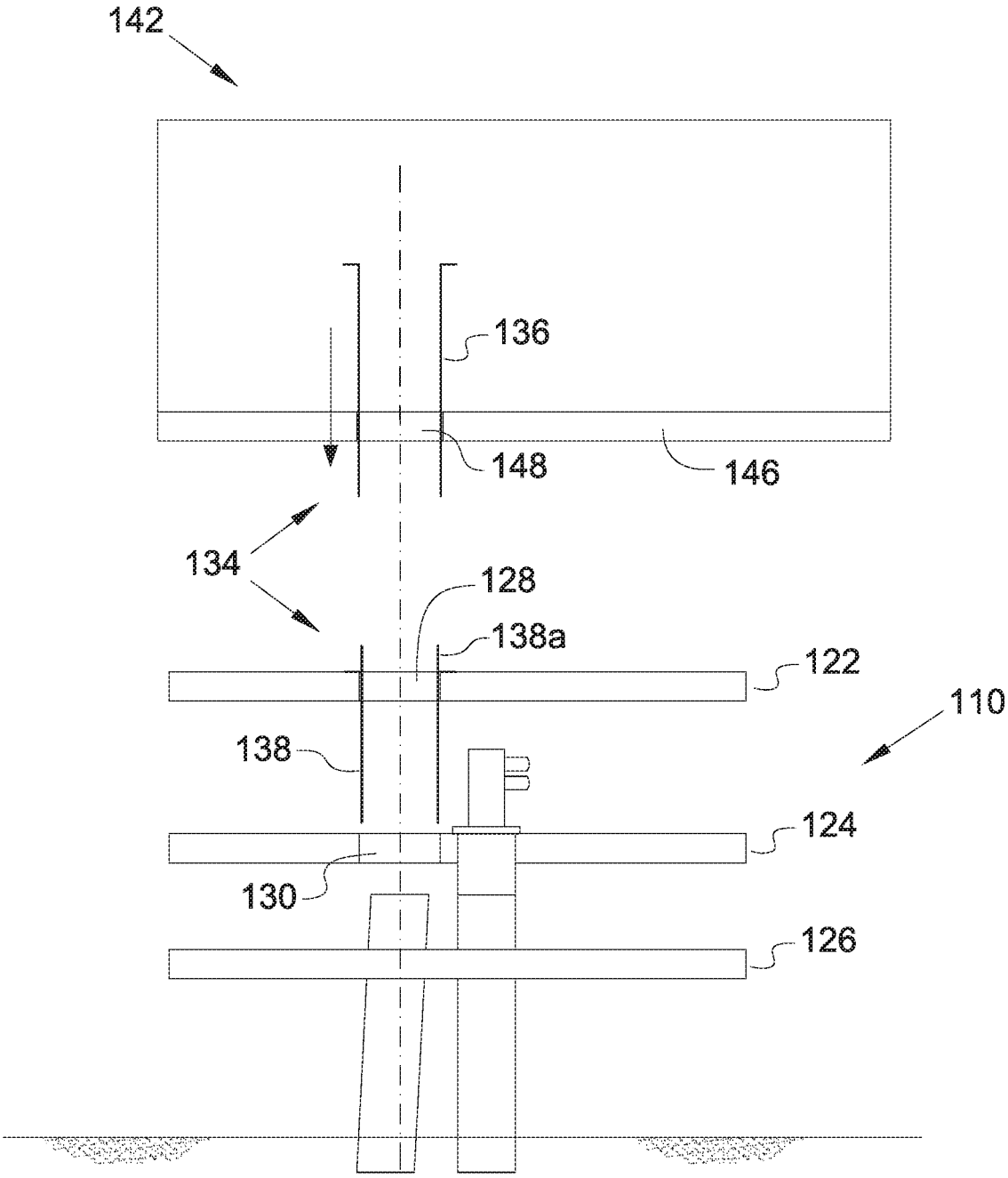
FIG. 3A is a diagrammatic illustration of a further example of an offshore platform during the process of deploying a sheath arrangement.

Reference is now made to FIG. 3A in which a further modified example of an offshore platform 110 is illustrated. The platform 110 is similar in many respects to platform 10 of FIGS. 1A and 1B and as such like features share like reference numerals, incremented by 100. Thus, the platform 110 includes an upper deck 122, a first lower deck 124 and a second lower deck 126, wherein the upper deck 122 defines an upper deck aperture 128, and the first lower deck 124 defines a first lower deck aperture 130.

In the present example a sheath arrangement 134 is also provided. However, in this example a lower section 138 of the sheath arrangement 134 is mounted on the upper deck 122, extending through the upper deck aperture 128 towards the first lower deck 124, with a short stub portion 138*a* extending upwardly from the upper deck 122. The sheath arrangement 134 includes a separate upper section 136, which in FIG. 3A is shown being passed downwardly from a rig cantilever 142, through a rig aperture 148 formed in a rig floor 146.

Figure 3B:
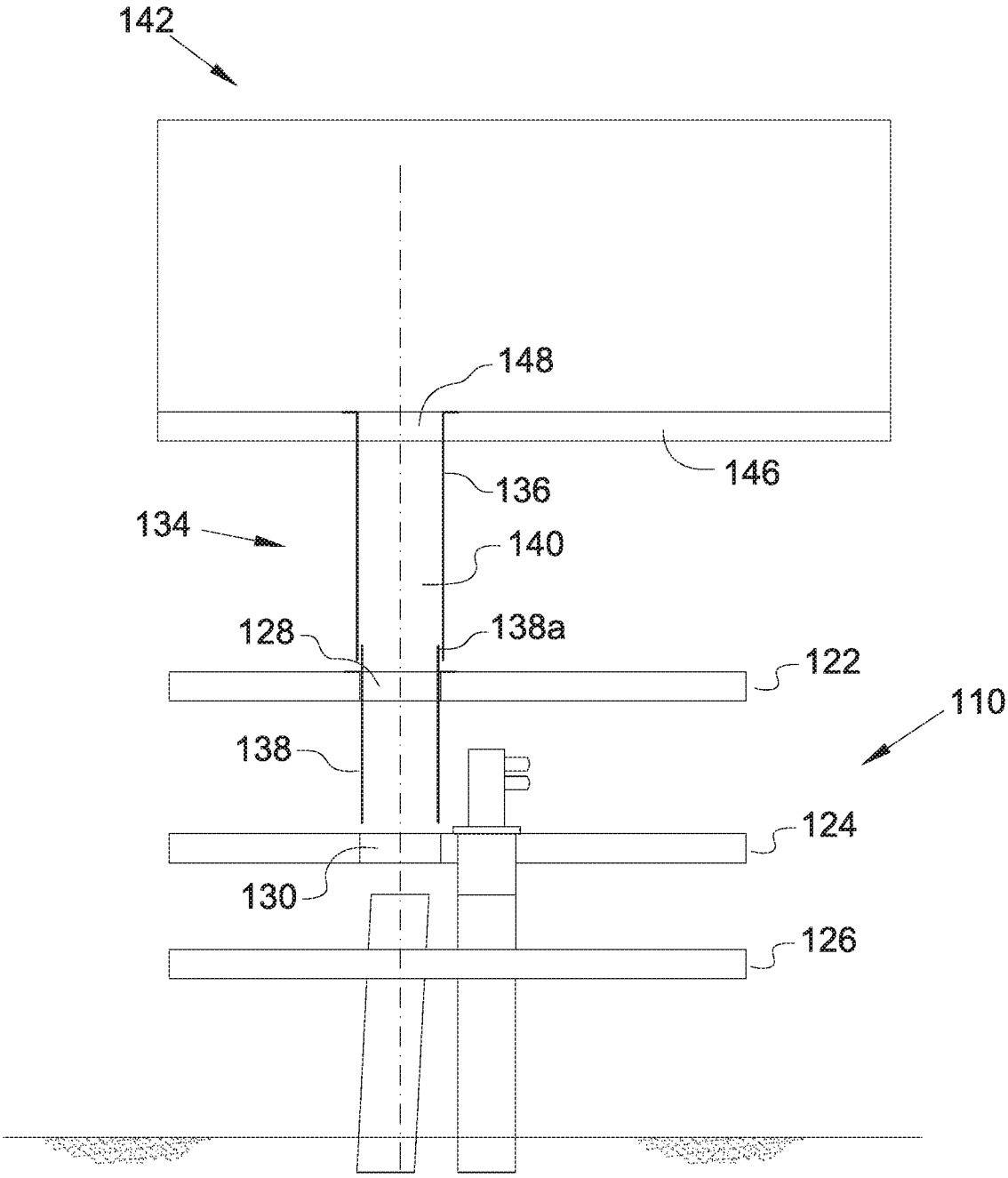
FIG. 3B illustrates the offshore platform of FIG. 4A, with the sheath arrangement deployed.

When fully deployed from the rig cantilever 142, as illustrated in FIG. 3B, the upper sheath section 136 is received over the stub portion 138*a* of the lower sheath section 138, thus creating a confinement zone 140 for confining objects passing downwardly through the rig aperture 148.

Figure 4A:
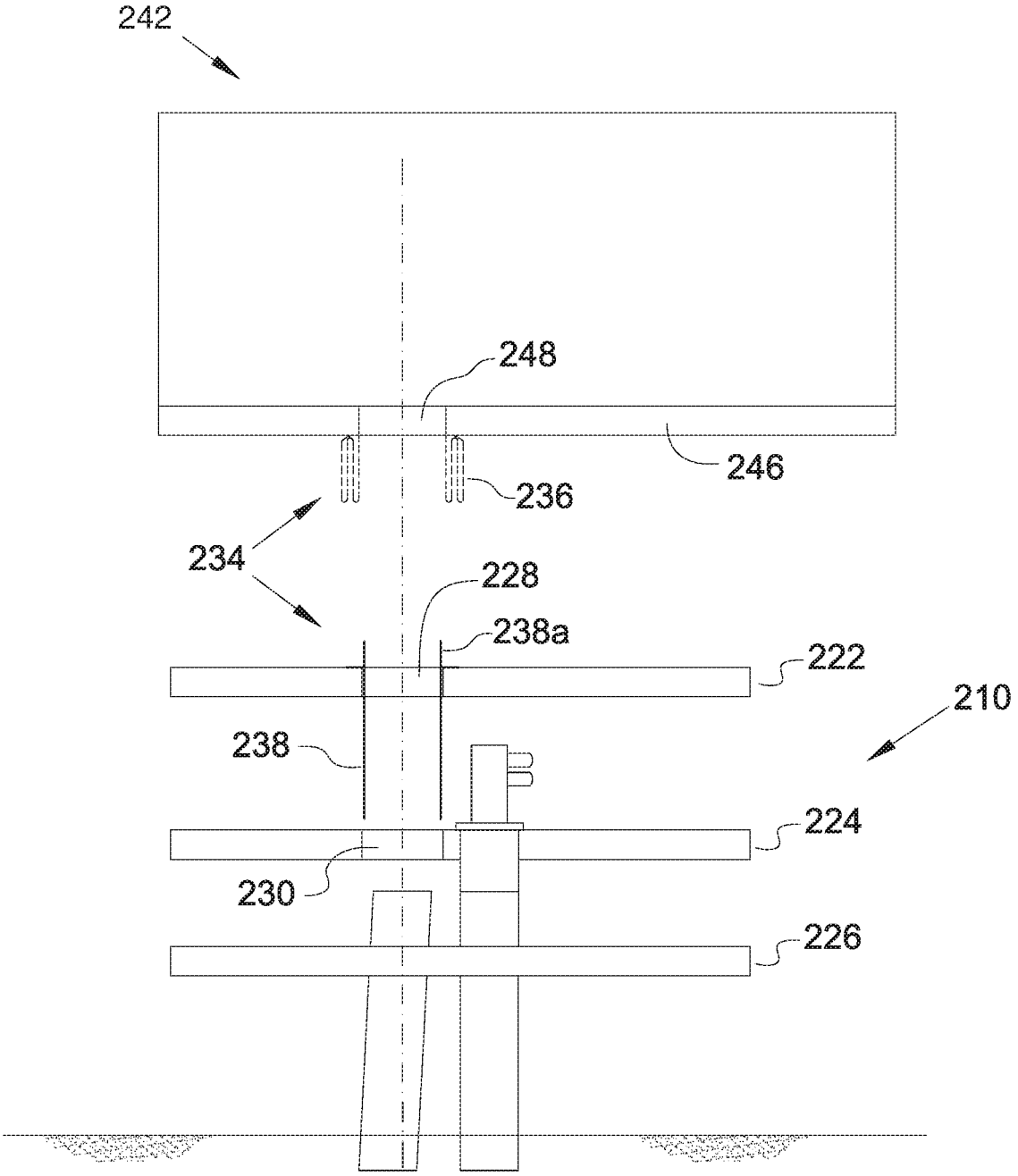
FIG. 4A is a diagrammatic illustration of a further example of an offshore platform prior to complete deployment of a sheath arrangement.

A further modified example of an offshore platform 210 is illustrated in FIG. 4A. The platform 210 is similar in many respects to platform 110 of FIGS. 3A and 3B and as such like features share like reference numerals, incremented by 100. Thus, the platform 210 includes an upper deck 222, a first lower deck 224 and a second lower deck 226, wherein the upper deck 222 defines an upper deck aperture 228, and the first lower deck 224 defines a first lower deck aperture 230.

In the present example a sheath arrangement 234 is also provided, with a lower section 238 of the sheath arrangement 234 mounted on the upper deck 222, extending through the upper deck aperture 228 towards the first lower deck 224, with a short stub portion 238*a* extending upwardly from the upper deck 222. The sheath arrangement 234 includes a separate upper section 236, which is provided in the form of a flexible curtain suspended from the floor 246 of a rig cantilever 242, around the periphery of a rig aperture 248. The flexible curtain may be formed from a chain-link material, for example.

Figure 4B:
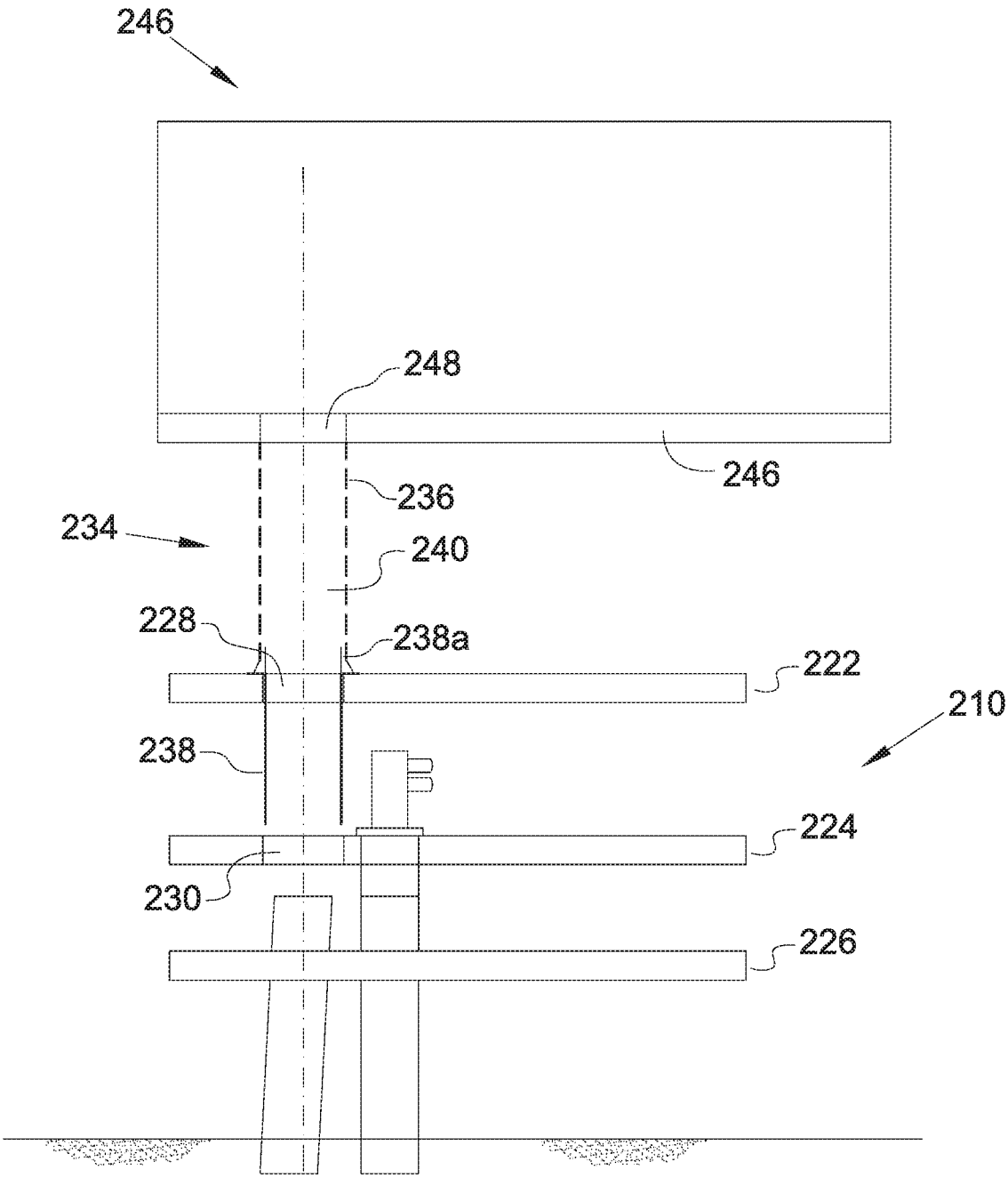
FIG. 4B illustrates the offshore platform of FIG. 5A, with the sheath arrangement fully deployed.

In FIG. 4A the upper sheath section 236 is shown in a retracted, or folded, state. When fully deployed from the rig cantilever 242, as illustrated in FIG. 4B, the upper sheath section 236 is received over the stub portion 238*a* of the lower sheath section 238, thus creating a confinement zone 240 for confining objects passing downwardly through the rig aperture 248. The lower end of the flexible upper sheath section 236 may be tethered or otherwise secured to the upper deck 222.

Figure 5:
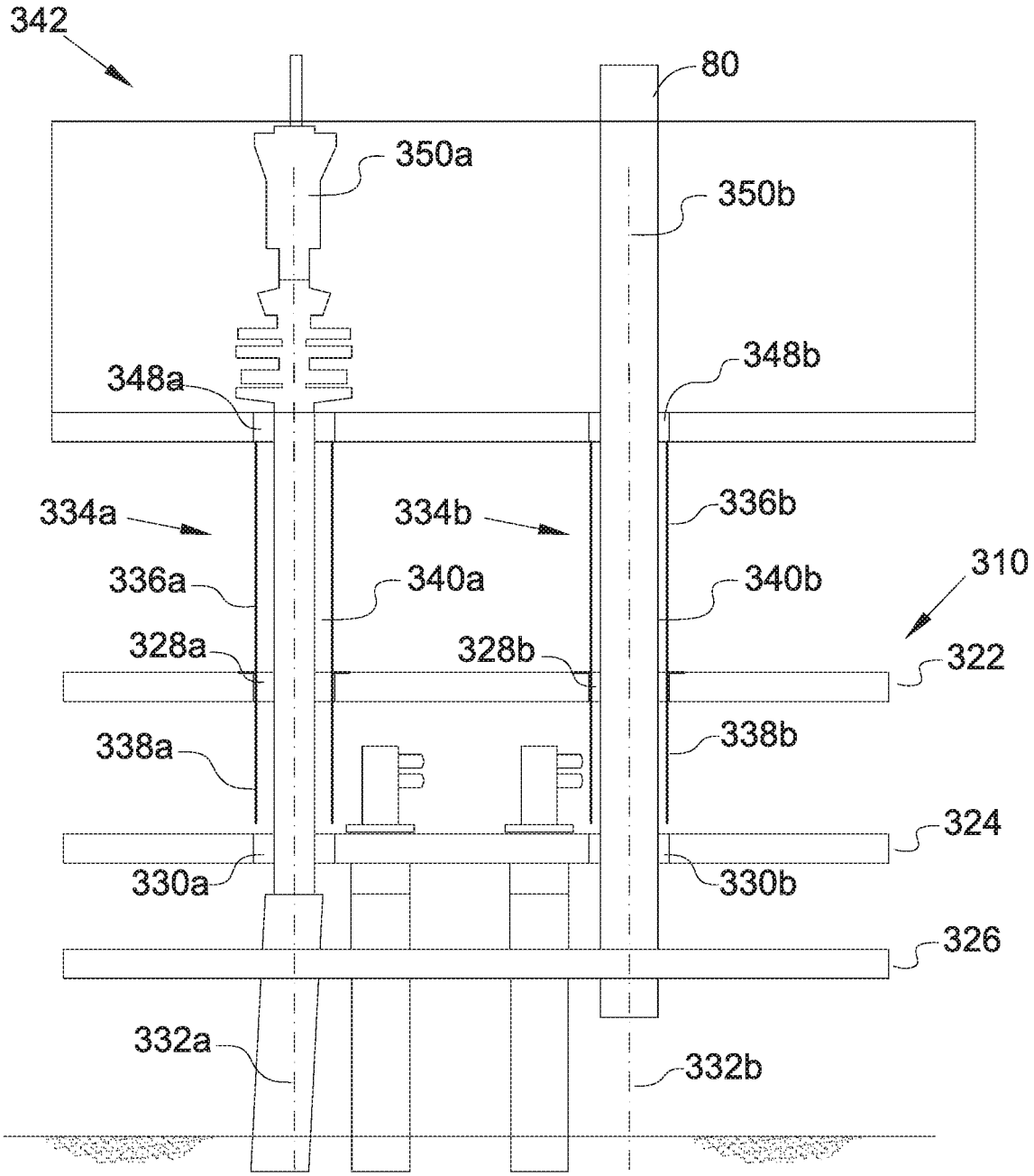
FIG. 5 is a diagrammatic illustration of a further example of an offshore platform.

In the examples provided above the rig cantilever includes a single drill centre. However, in other examples an offshore platform may be provided which is operational with a rig cantilever which includes multiple drill centres, such as in the example illustrated in FIG. 5. In this example the offshore platform 310 includes a number of decks, including an upper deck 322, a first lower deck 324 and a second lower deck 326 arranged one above the other. The upper deck 322 defines two upper deck apertures 328*a*, 328*b*, and the first lower deck 324 defines two first lower deck apertures 330*a*, 330*b*, wherein the respective apertures 328*a*, 328*b*, 330*a*,

330*b* are aligned on first and second platform axes 332*a*, 332*b*. In the example illustrated separate clusters of wells 14 are arranged around the platform axes 332*a*, 332*b*.

A rig cantilever 342 is operated over the platform 310, wherein the rig cantilever 342 includes first and second drill centres 350*a*, 350*b* which are aligned with the respective first and second platform axes 332*a*, 332*b*. The rig cantilever 342 includes first and second rig apertures 348*a*, 348*b* provided on the respective first and second drill centres 350*a*, 350*b*.

A first sheath arrangement 334*a* is aligned on the first platform axis 332*a*, and includes an upper portion 336*a* which extends upwardly relative to the upper deck 322, and a lower portion 338*a* which extends downwardly relative to the upper deck 322 towards the lower deck 324. The first sheath arrangement 334*a* thus defines a first confinement zone 340*a* above both the upper and first lower decks 322, 324.

A second sheath arrangement 334*b* is aligned on the second platform axis 332*b*, and includes an upper portion 336*b* which extends upwardly relative to the upper deck 322, and a lower portion 338*b* which extends downwardly relative to the upper deck 322 towards the lower deck 324. The second sheath arrangement 334*b* thus defines a second confinement zone 340*b* above both the upper and first lower decks 322, 324.

The provision of the separate drill centres 350*a*, 350*b* may permit multiple operations to be performed simultaneously. For example, in the illustrated example of FIG. 5 a drilling operation is being performed along the first drill centre 350*a*, whereas a conductor pipe 80 is being deployed along the second drill centre 350*b*.

Thus, during operations any objects passing, for example dropped, from the rig cantilever 342 will be confined within the first and second confinement zones 340*a*, 340*b* defined by the respective first and second sheath arrangements 334*a*, 334*b*.

Figure 6A:
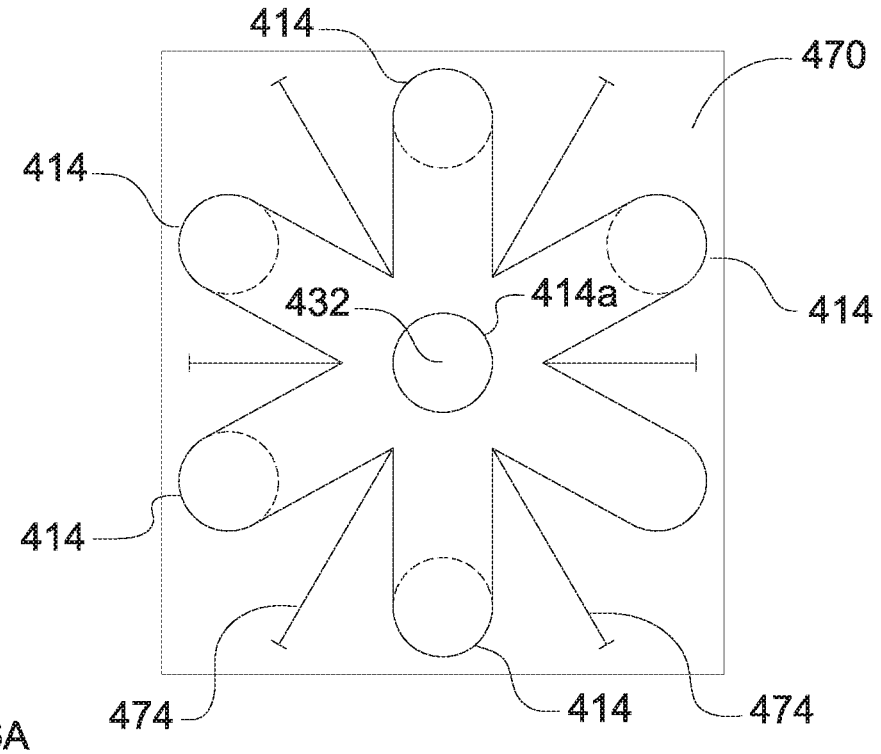
FIG. 6A is a diagrammatic illustration of a cross sectional view through a plate arrangement of FIG. 6B.
Figure 6B:
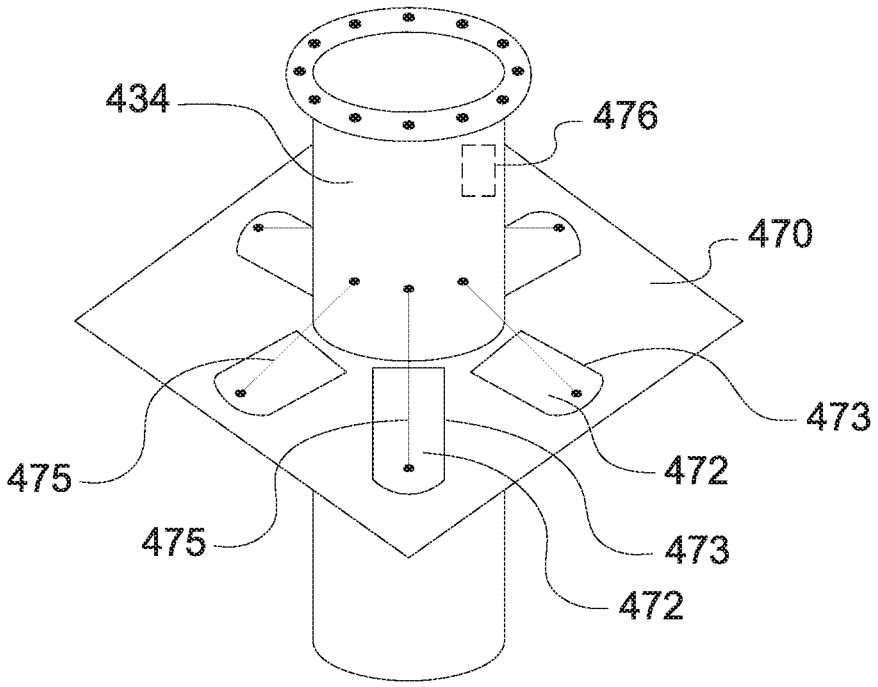
FIG. 6B is a diagrammatic illustration of a further example of a sheath arrangement including the plate arrangement.
Figure 6C:
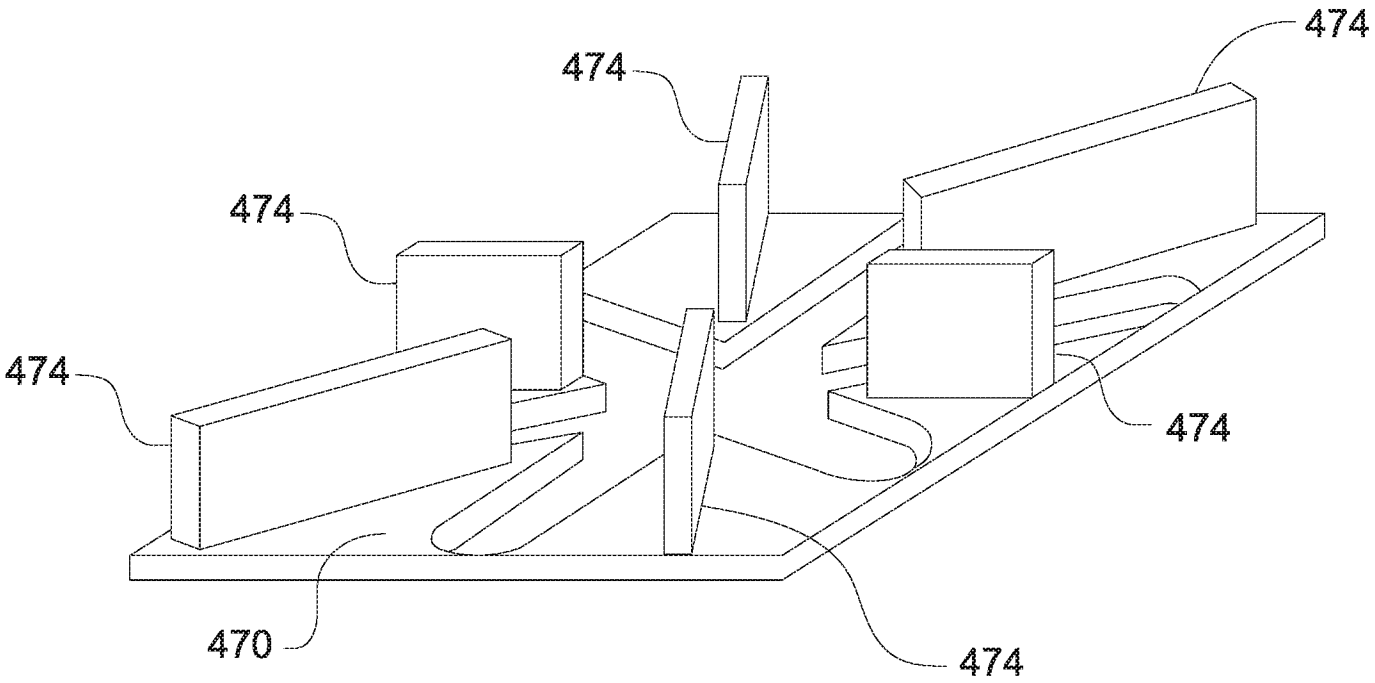
FIG. 6C illustrates the plate arrangement of FIG. 6B.

Reference is now made to FIGS. 6A, 6B and 6C in which a further example of a sheath arrangement 434 is illustrated. The sheath arrangement 434 is similar in many respects to the sheath arrangement 34 shown in relation to platform 10 of FIGS. 1A and 1B and as such like features share like reference numerals, incremented by 400. Thus, the platform (not shown) in which sheath arrangement 434 is to be used includes an upper deck 422, a first lower deck 424 and a second lower deck 426, wherein the upper deck 422 defines an upper deck aperture 428, and the first lower deck 424 defines a first lower deck aperture 430. The new features shown in relation to the sheath arrangement 434 in the example of the offshore platform in FIGS. 6A, 6B and 6C are equally applicable to the offshore platform 110, 210 and 310 of previous examples.

FIG. 6A shows a cross sectional view through a plate arrangement 470 of FIG. 6B (as will be explained). The plate arrangement 470 is configured to allow, or indeed prevent, access to a cluster of wells 414 around a platform axis 432. In this example, six wells 414 are shown but in other embodiments there could be more or fewer. In a similar manner to that explained for FIG. 1, well 414*a* has been bent into line with the platform axis 432 and is thus located centrally within the cluster of wells (e.g. at the drill centre). The sheath arrangement 434 (not shown) is aligned with the platform axis 432 and is also located centrally within the cluster of wells 414. In this example, the plate arrangement 470 is located at the bottom of the sheath arrangement 434. However in other examples, the sheath arrangement 434 can also extend below the plate arrangement 470.

Here, the plate arrangement 470 is located on the outside of the sheath arrangement 434 and can be considered to extend horizontally outwardly from the sheath arrangement 434 to form a flange that covers the area above the wells 414. While in some cases, the plate arrangement 470 may be positioned relative to the sheath arrangement 434 when use is desired, in this example the plate arrangement 470 may be considered to be attached to the sheath arrangement 434. The plate arrangement 470 is intended to be located between upper deck 422 and a first lower deck 424, i.e. directly above production trees 420 located above the first lower deck 424. In other embodiments, the plate arrangement 470 may be located above upper deck 422 or at another position along the sheath arrangement 434. In other embodiments, the plate arrangement 470 may cover only some of the wells 414.

A perspective view of the sheath arrangement 434 and the plate arrangement 470 is shown in FIG. 6B with the sheath arrangement 434 extending both above and below the horizontal plane of the plate arrangement 470. Here, the plate arrangement 470 is provided with operable hatches 472 (shown in FIG. 6B), which are openable and closable. The hatches 472 can be raised and lowered to open and close respectively by retaining members 475. In this example, there are six hatches 472, one for access to each well 414. In other embodiments, there may be fewer or more than six hatches 472 provided in the plate arrangement 470. When opened, the hatches 472 provide plate apertures 473 in the plate arrangement 470. The hatches 472 allow operations to be carried out on the other wells 414 through the apertures 473 when the sheath arrangement 434 is above well 414*a*. The hatches 472 also allow equipment to be passed through the plate arrangement 470 (e.g. when needed). For example, intervention operations (e.g. wireline operations) can be carried out in one or more wells 414 through the plate apertures 473 while drilling is occurring through the sheath arrangement 434 in well 414*a*.

Further, referring now to FIG. 6C, separation plates 474 are provided in the example, which extend downwards from the plate arrangement 470. The separation plates 474 can also be seen in FIG. 6A. Six separation plates 474 are provided in this example but more or fewer could be provided depending on the number of wells 414. The bottoms of the separation plates 474 come into contact with the first lower deck 424 before the plate arrangement 470 contacts the wellheads of the wells 14 when the sheath arrangement 434 is lowered. This may reduce impact on the wellheads of the wells 414.

The separation plates 474 are configured to assist with safety by further confining objects that may be accidentally dropped through hatches 472. That is, objects dropped through the hatches 472 at an angle to the vertical will impact the separation plates 474 and thus be confined to an area between the separation plates 474 and those adjacent wells. In this embodiment, the separation plates 474 are straight and extend outwardly from the sheath arrangement 434 but, in other embodiments, they could be any other suitable shape. There are spaces between the separation plates 474 to allow movement of the wells 414 to the platform axis 432.

Further shown here is an access hatch 476, which is provided in the sheath arrangement 434 as shown by dotted lines in FIG. 6B. The access hatch 476 allows access to the confinement zone 440 of the sheath arrangement 434. Although the access hatch 476 is intended in this example to be above the upper deck 422, it may be located in any position along the sheath arrangement 434, e.g. between the first lower deck 424 and the second lower deck 426. However, the access hatch 476 may be arranged such that, when in situ, the access hatch 476 is user accessible from a deck (e.g. the upper deck). Such an access hatch 476, when opened, may permit access to the equipment passing within the sheath arrangement 434.

It will readily be appreciated that in some examples it may be helpful for the sheath arrangement 434 to flex compliantly in order to accommodate relative movement between the offshore rig and upper deck 422, when in use. Compliance, in this regard may be considered to mean, for example, the sheath arrangement 434 may be axially and/or longitudinally compliant in order to accommodate some relative movement between the offshore rig and upper deck 422, when in use.

In some examples, that compliance may be provided by the structure of the sheath arrangement 434 itself. Otherwise, and in the example shown, the sheath arrangement 434 may comprise compliant portions, (e.g. one or more flex joints (not shown)). Here, the flex joint is provided by a portion of the sheath arrangement 434 that is flexible. That is, the flex joint is not rigid and can bend etc. to accommodate the difference in motion between the platform 410 and the rig cantilever (not shown).

While in some of the above examples, the various embodiments have been described using the sheath arrangement 434 together with the rig cantilever, it will be appreciated that the sheath arrangement 434 may be readily useable when also performing intervention operations, e.g. using wireline line setups. That is, while drilling is occurring in one well structure, wireline operations can be carried out in another well structure. A skilled reader will readily be able to implement these embodiments accordingly.

It should be understood the examples described above are indeed merely exemplary and that various modifications may be made thereto without departing from the scope of the invention.

The invention claimed is:

1. An offshore platform for use in combination with an offshore rig, comprising:

an upper deck defining a first upper deck aperture, the first upper deck aperture being alignable with a first rig aperture of the offshore rig by displacing the offshore ring to extend over the upper deck, whereby objects become permitted to extend between the offshore rig and through the upper deck; and a first sheath arrangement aligned with the first upper deck aperture and extending upwardly relative to the upper deck to be alignable with the first rig aperture, wherein the sheath arrangement defines a first confinement zone for confining objects which pass downwardly from the offshore rig through the first rig aperture.

2. The offshore platform according to claim 1, wherein the offshore platform is an offshore wellhead platform configured to accommodate an upper terminating end of at least one well.

3. The offshore platform according to claim 2, wherein the terminating upper end of the at least one well is alignable with the first upper deck aperture.

4. The offshore platform according to claim 1, wherein the first sheath arrangement circumscribes the first upper deck aperture.

5. The offshore platform according to claim 1, wherein the first sheath arrangement extends upwardly from the level of the upper deck.

6. The offshore platform according to claim 1, wherein the first sheath arrangement is securable around a peripheral region of the first upper deck aperture.

7. The offshore platform according to claim 1, wherein the first sheath arrangement is securable around a peripheral region of the first rig aperture.

8. The offshore platform according to claim 1, wherein the first sheath arrangement extends through the first upper deck aperture.

9. The offshore platform according to claim 1, wherein the first sheath arrangement extends through the first rig aperture.

10. The offshore platform according to claim 1, wherein at least a portion of the first sheath arrangement is rigid.

11. The offshore platform according to claim 1, wherein at least a portion of the first sheath arrangement is flexible to define a sheath curtain.

12. The offshore platform according to claim 1, wherein at least a portion of the first sheath arrangement is supported by at least one of the upper deck and the offshore rig.

13. The offshore platform according to claim 1, wherein at least a portion of the first sheath arrangement is at least one of:

extended from the offshore rig during deployment of the first sheath arrangement; and extended from the offshore platform and upwardly towards the offshore rig during deployment of the first sheath arrangement.

14. The offshore platform according to claim 1, wherein the first sheath arrangement comprises a hoisting support arrangement.

15. The offshore platform according to claim 1, wherein the first sheath arrangement comprises a first component connected or mounted to the offshore platform, and a second component connected or mounted to the offshore rig.

16. The offshore platform according to claim 1, wherein the first sheath arrangement comprises a compliant portion.

17. The offshore platform according to claim 1, wherein the first sheath arrangement is telescopic.

18. The offshore platform according to claim 1, wherein the first sheath arrangement extends downwardly relative to the upper deck towards a first lower deck to define a lower confinement zone for confining objects passing between the upper and first lower decks.

19. The offshore platform according to claim 18, wherein the first sheath arrangement defines an upper sheath portion extending upwardly relative to the upper deck and a lower sheath portion extending downwardly relative to the upper deck.

20. The offshore platform according to claim 1 wherein the offshore rig comprises a cantilever portion which is extendable over the upper deck of the offshore platform, the cantilever portion defining the first rig aperture.

21. The offshore platform according to claim 1, wherein the upper deck defines a second upper deck aperture which is alignable with a second rig aperture of the offshore rig, when said offshore rig extends over the upper deck, to permit objects to extend between the offshore rig and through the upper deck.

22. The offshore platform according to claim 21, comprising a second sheath arrangement aligned with the second upper deck aperture and extending upwardly relative to the upper deck to be alignable with the second rig aperture, wherein the second sheath arrangement defines a second confinement zone for confining objects which pass downwardly from the offshore rig through the second rig aperture.

23. A method for confining objects extending between an offshore platform and an offshore rig which extends over an upper deck of the offshore platform such that an upper deck aperture of the offshore platform is alignable with a rig aperture of the offshore rig by displacing the offshore rig to extend over the upper deck, the method comprising:

extending a sheath arrangement between the upper deck of the offshore platform and the offshore rig such that the sheath arrangement is aligned with the upper deck aperture and the rig aperture and defines a confinement zone for confining objects which pass downwardly from the offshore rig through the rig aperture.

24. An offshore platform for use in combination with an offshore rig, comprising:

an upper deck defining a first upper deck aperture which is alignable with a first rig aperture of the offshore rig when said offshore rig extends over the upper deck, to permit objects to extend between the offshore rig and through the upper deck; and a first sheath arrangement aligned with the first upper deck aperture and extending upwardly relative to the upper deck to be alignable with the first rig aperture, wherein the sheath arrangement defines a first confinement zone for confining objects which pass downwardly from the offshore rig through the first rig aperture, wherein the offshore rig defines a first drill center and the first rig aperture is provided on the first drill center such that the first drill center is positionable within the first confinement zone defined by the first sheath.

25. The offshore platform according to claim 24, wherein the offshore platform accommodates multiple wells arranged in a cluster.

26. The offshore platform according to claim 25, wherein the upper end of at least one of the multiple wells is moveable to be selectively aligned and misaligned with the first drill center of the offshore rig.

27. An offshore system, comprising:

an offshore platform having an upper deck defining an upper deck aperture;

an offshore rig having a rig aperture, wherein the offshore rig is extendable over the upper deck of the offshore platform by displacing the offshore rig to align the rig aperture with the upper deck aperture and permit objects to extend between the offshore rig and through the upper deck; and a sheath arrangement extendable between the upper deck of the offshore platform and the offshore rig such that the sheath arrangement is aligned with the upper deck aperture and the rig aperture and defines a confinement zone for confining objects which pass downwardly from the offshore rig through the rig aperture.

* * * * *